US009951591B2

(12) United States Patent
Boyd

(10) Patent No.: US 9,951,591 B2
(45) Date of Patent: Apr. 24, 2018

(54) BYPASS PLUNGER

(71) Applicant: Flowco Production Solutions, LLC, Spring, TX (US)

(72) Inventor: Garrett Boyd, Godley, TX (US)

(73) Assignee: Flowco Production Solutions, LLC, Spring, TX (US)

( * ) Notice: Subject to any disclaimer, the term of this patent is extended or adjusted under 35 U.S.C. 154(b) by 387 days.

(21) Appl. No.: 14/796,548

(22) Filed: Jul. 10, 2015

(65) Prior Publication Data

US 2016/0010436 A1 Jan. 14, 2016

Related U.S. Application Data

(60) Provisional application No. 62/023,256, filed on Jul. 11, 2014.

(51) Int. Cl.
*E21B 43/12* (2006.01)

(52) U.S. Cl.
CPC ..... *E21B 43/121* (2013.01)

(58) Field of Classification Search
CPC .... E21B 43/121; E21B 43/122; E21B 43/123; F04B 47/12
See application file for complete search history.

(56) References Cited

U.S. PATENT DOCUMENTS 2,661,024 A 12/1953 Knox
2,714,855 A 8/1955 Brown
2,878,754 A * 3/1959 McMurry ..... E21B 43/121 417/555.2
2,970,547 A 2/1961 McMurry
3,020,852 A * 2/1962 Roach ..... E21B 43/127 277/336
3,055,306 A 9/1962 Tausch
3,090,315 A * 5/1963 Milton ..... F04B 47/12 277/322
3,181,470 A 5/1965 Clingman
3,412,798 A 11/1968 Gregston
3,861,471 A 1/1975 Douglas
4,239,458 A 12/1980 Yeatts
4,502,843 A 3/1985 Martin
4,531,891 A 7/1985 Coles, III
4,629,004 A 12/1986 Griffin
5,253,713 A 10/1993 Gregg et al.
5,427,504 A 6/1995 Dinning et al.
6,045,335 A 4/2000 Dinning
6,148,923 A 11/2000 Casey
(Continued)

FOREIGN PATENT DOCUMENTS

CA 2428618 C 4/2008

*Primary Examiner* — Michael R Wills, III
(74) *Attorney, Agent, or Firm* — Whitaker Chalk Swindle & Schwartz PLLC; Stephen Mosher

(57) ABSTRACT

A minimum parts bypass plunger includes a main shaft or pushrod extending through a hollow plunger body that incorporates flow passages formed in the adjacent surfaces of the pushrod or the internal bore of the plunger body. The pushrod is retained within the plunger body by respective head and tail pieces or caps that are locked to the plunger body by 360 degree crimps around the head and tail pieces. A one piece clutch is supported in the head piece. The pushrod, has an integral valve head that closes the flow passages when seated against a seat in the plunger body.

28 Claims, 10 Drawing Sheets

(56) References Cited

U.S. PATENT DOCUMENTS

| | | | | |
|---|---|---|---|---|
| 6,176,309 | B1 | 1/2001 | Bender | |
| 6,200,103 | B1 | 3/2001 | Bender | |
| 6,209,637 | B1 | 4/2001 | Wells | |
| 6,467,541 | B1 | 10/2002 | Wells | |
| 6,554,580 | B1 | 4/2003 | Mayfield et al. | |
| 6,637,510 | B2 | 10/2003 | Lee | |
| 6,644,399 | B2 * | 11/2003 | Abbott | E21B 43/121 166/101 |
| 6,669,449 | B2 | 12/2003 | Giacomino | |
| 6,725,916 | B2 | 4/2004 | Gray et al. | |
| 6,907,926 | B2 | 6/2005 | Bosley | |
| 7,121,335 | B2 * | 10/2006 | Townsend | E21B 43/121 166/105 |
| 7,290,602 | B2 | 11/2007 | Victor | |
| 7,314,080 | B2 | 1/2008 | Giacomino | |
| 7,328,748 | B2 | 2/2008 | Giacomino | |
| 7,438,125 | B2 | 10/2008 | Victor | |
| 7,475,731 | B2 | 1/2009 | Victor | |
| 7,513,301 | B2 | 4/2009 | Victor | |
| 7,523,783 | B2 | 4/2009 | Victor | |
| 8,181,706 | B2 | 5/2012 | Tanton | |
| 8,627,892 | B2 | 1/2014 | Nadkrynechny | |
| 2014/0116714 | A1 | 5/2014 | Jefferies et al. | |

* cited by examiner

BYPASS PLUNGER

CROSS REFERENCE TO RELATED APPLICATION

This Application claims priority to U. S. Provisional Patent Application Ser. No. 62/023,256 filed Jul. 11, 2014 and entitled BYPASS PLUNGER.

BACKGROUND OF THE INVENTION

1. Field of the Invention

The present invention generally relates to bypass plungers and more particularly to bypass plungers adapted through novel design features to control descent, extend useful life, and resist failures from loosening assemblies.

2. Background of the Invention and Description of the Prior Art

In the well bores constructed in subterranean formations to access deposits of oil and gas, fluids can build up and impede production of the oil and gas. One effective device frequently used to overcome this condition is to use a plunger apparatus that is configured to freely cycle upward and downward in the well bore. Such plunger devices are variously called gas lift plungers, differential pressure operated pistons, bypass plungers, auto-cycling plungers, and the like. The plunger is released into the well bore at the surface and allowed to fall toward the distal or bottom end of the well bore through fluid or gas that may be present in the well. At the end, pressure builds under it and causes the plunger to travel toward the surface, lifting the fluids ahead of it. As the plunger reaches the surface, the fluids are discharged, and the plunger is released to fall back into the well bore to, the distal or bottom end to repeat the cycle. The cycle is typically repeated numerous times each day to allow the well to resume production.

Conventional bypass or gas-lift plungers are characterized by several inefficiencies, among them slow or erratic operation, inability to tolerate impact and high pressures, susceptibility to rapid wear, failure of clutches used to retain the stem or pushrod or a portion of a valve in position, obstruction of fluid flow or susceptibility to deposits that impede fluid flow through the plunger, etc. Further, some typical plungers are complex, requiring many parts, which usually entails additional operations during manufacturing or repair resulting in higher costs.

For example, any obstruction to the flow of fluid can impede the descent of the plunger. Such obstruction can be rough or protruding features in the flow path, lack of smooth transitions in the flow path, etc. Roughness or other obstructions can accumulate debris, restricting the flow path and cause erratic descent of the plunger. Pins and screws used to retain head and tail pieces or other components to the body portion of the plunger may be sheared when the plunger impacts the bottom of the well bore, for example when the bumper assembly at the well bottom is inoperative or it malfunctions. Screws can loosen if steps are not taken to lock them in place. Clutch assemblies that have several operative components provide additional potential problems if one of the components such as a spring or other part to fail. A clutch malfunction usually means the plunger is disabled, which may require time-consuming procedures to retrieve it from the well bore and a consequent loss of production and increase in operating costs.

SUMMARY OF THE INVENTION

Accordingly there is provided a bypass plunger, comprising a hollow cylindrical body having a longitudinal bore therethrough and external threads at first and second opposite ends for respectively receiving a head piece and a tail piece; a one piece pushrod configured as a shaft having an enlarged valve head disposed between a mid-section and the second end stem, wherein the pushrod is slidably disposed within the longitudinal bore of the hollow cylindrical body between an open state and a closed state; the head piece having internal threads at a lower end skirt thereof for attachment to the external threads of the first end of the hollow cylindrical body; and the tail piece having internal threads at an upper end skirt thereof for attachment to the external threads of the second end of the hollow cylindrical body; wherein the head and tail pieces are secured to the hollow cylindrical body by a 360 degree crimp that deforms the skirts of the head and tail pieces into a first preformed recess in the external threads of the hollow cylindrical body.

In another aspect, the bypass plunger includes a clutch assembly disposed within the internal bore of the head piece, the clutch assembly comprising a one piece clutch configured as a collet; a shield washer; and a retaining ring. Further, the one piece clutch comprises a collet having an outside diameter smaller than the inside diameter of the head piece and an inside diameter slightly smaller than the diameter of the first end stem; and a plurality of kerfs cut in sequence from alternate ends of the cylindrical body.

In another aspect, the bypass plunger includes a surface finish disposed substantially along the first end of the pushrod and selected from the group consisting of closely-spaced concentric grooves, screw threads, a knurled pattern, and an etched pattern.

In another aspect, the bypass plunger includes a plurality of uniformly-spaced splines formed into the surface of the mid-section of the pushrod; wherein a predetermined clearance is provided between the splines and the internal bore of the hollow body.

In another aspect, the bypass plunger includes a plurality of uniformly-spaced splines formed into the surface of the internal bore of the hollow body; wherein a predetermined clearance is provided between the splines and the surface of the mid-section of the pushrod.

In another embodiment, the bypass plunger of the present invention comprises a plurality of egress ports disposed through the wall of the headpiece and uniformly spaced therearound; and a plurality of ingress ports disposed through the wall of the tailpiece and uniformly spaced therearound.

In another embodiment, there is disclosed a clutch for use in a bypass plunger formed of an assembly of a main shaft slidingly disposed within a hollow cylindrical body capped at first and second ends by respective hollow head and tail pieces, comprising a collet configured for frictionally sliding along the main shaft within either the head piece or the tail piece and having a plurality of kerfs cut in sequence from alternate ends thereof; and an inside diameter slightly smaller than the outside diameter of the main shaft.

In an aspect of the clutch embodiment, at least one of the main shaft and the inside diameter of the collet includes a ridged surface wherein the ridged surface comprises a surface finish selected from the group consisting of alternate concentric ridges and grooves closely spaced, screw threads, a knurled surface, and an etched surface.

In another aspect of the clutch embodiment, the main shaft includes a first end and a second end and a bypass valve disposed on the second end thereof that cooperates with a valve seat within the hollow cylindrical body; and the valve is controlled by the clutch in cooperation with the first end of the main shaft.

In another embodiment of the present invention, there is disclosed a bypass plunger formed of an assembly of a main shaft slidingly disposed within a bore of a hollow cylindrical body along a longitudinal axis thereof and capped at first and second ends by respective hollow head and tail pieces, comprising a plurality of fluid ingress ports disposed through a wall portion of the tail piece; a plurality of fluid egress ports disposed through a wall portion of the head piece; and a plurality of fluid passages formed in the outer surface of the main shaft, wherein the fluid passages in alignment with the ingress and egress ports enable bypass of fluids through the bypass plunger while descending through a well bore.

In another embodiment of the present invention, there is disclosed a bypass plunger formed of an assembly of a main shaft slidingly disposed within a bore of a hollow cylindrical body along a longitudinal axis thereof and capped at first and second ends by respective hollow head and tail pieces, comprising a plurality of fluid ingress ports disposed through a wall portion of the tail piece; a plurality of fluid egress ports disposed through a wall portion of the head piece; and a plurality of fluid passages formed in the surface of the bore of the hollow cylindrical body, wherein the fluid passages in alignment with the ingress and egress ports enable bypass of fluids through the bypass plunger while descending through a well bore.

DETAILED DESCRIPTION OF THE INVENTION

Figure 1:
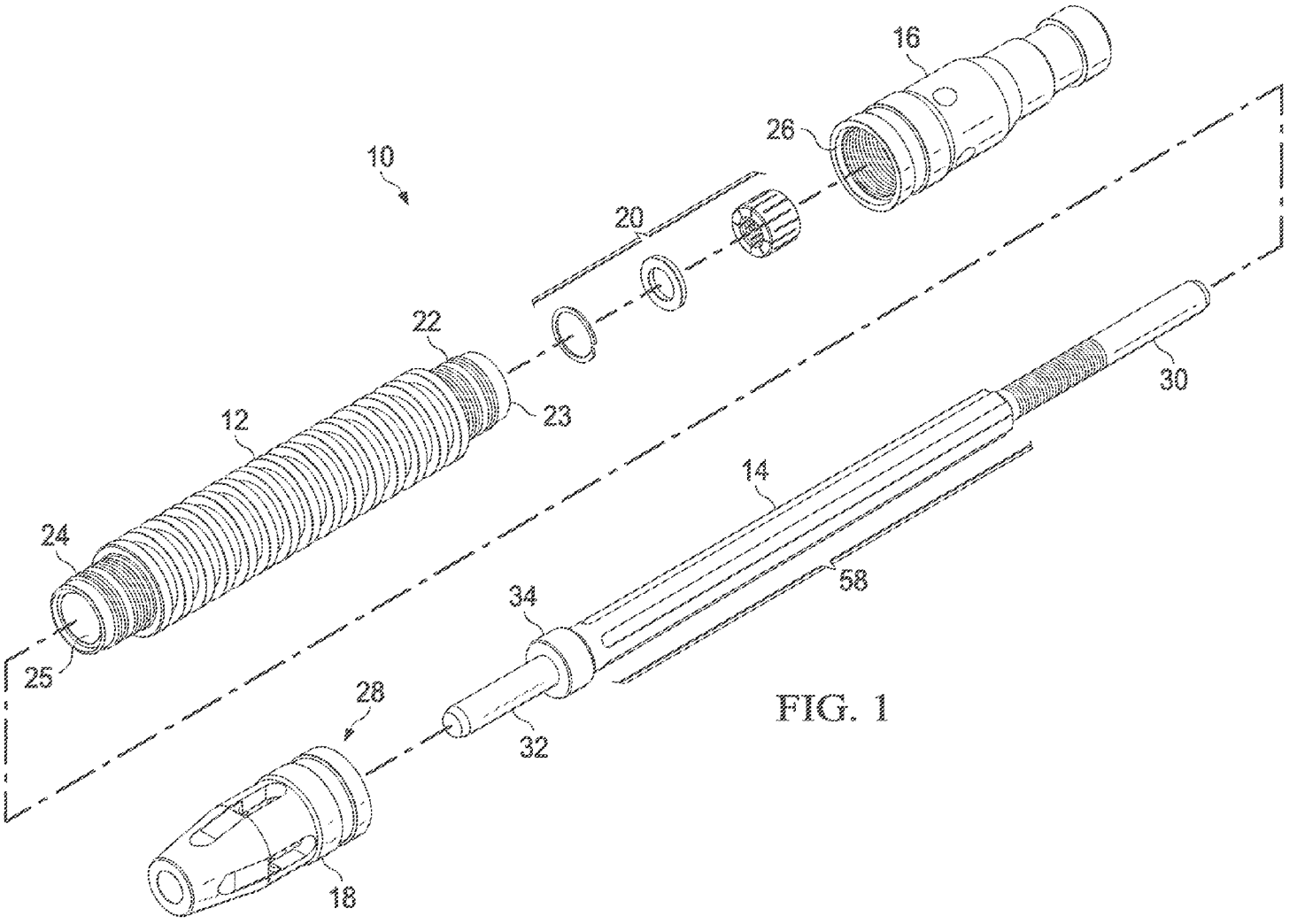
FIG. 1 illustrates an exploded view of a bypass plunger according to embodiments of the present invention.

The bypass plunger according to the present invention provides advances in the state of the art that includes several novel features to improve its performance and reliability, extend the useful life of a bypass plunger, and reduce the costs of manufacturing and repairing bypass plungers. The basic minimum parts design disclosed herein features an internal pushrod or main shaft that extends through the full length of the hollow cylindrical body of the plunger. See FIGS. 1, 2 and 3. The pushrod, also known as a shift rod, includes an enlarged section that acts as a valve that opens and closes fluid flow passages within the body of the bypass plunger. The pushrod is retained within the hollow body by a head piece and a tail piece, which function as caps that are threadably attached to the hollow body. A clutch resides in the head piece, in the illustrated example, to hold the pushrod and its valve in its open and closed positions to enable descent and ascent of the plunger, respectively. See FIGS. 1 and 5. Passages through the wall portions of the head and tail pieces in alignment with the internal portions of the hollow body and pushrod assembly allow fluids to flow through the device upon descent. See FIGS. 1, 3 and 10. The passages are blocked by a valve when the plunger reaches the bottom of a well bore, preparing it for ascent to the surface.

In the description that follows, four embodiments of the present invention are disclosed. In a first embodiment of the invention the push rod is retained by a threaded head piece and a threaded tail piece that are locked with a unique, full-perimeter crimp around the skirt of the head and tail pieces at the position of the threaded portions of the body to which the head and tail pieces are secured. See FIGS. 2, 3 and 4. A second embodiment is a one piece clutch design disposed within the head piece and along a grooved, etched, knurled, or threaded surface formed on the stem of the pushrod to provide a non-slip surface that the clutch can more readily grasp. The one piece clutch configuration provides an effective clutch without the need for circumferential coil springs surrounding a two-piece clutch collar. This clutch design prevents slippage of the pushrod relative to the body of the plunger when the plunger is in the "open" or "closed" configuration. See FIGS. 5, 6 and 7.

In a third embodiment with two aspects, the outer surface of the mid-section of the pushrod is provided with longitudinal grooves, as on a splined shaft (that appear, in cross section, like a spur gear), while the interior bore of the hollow body of the plunger is smooth. See FIG. 8A. This combination, when the pushrod is installed within the hollow body, provides passages for the flow of fluids through the body of the plunger. See FIG. 10. An alternate aspect of this design is to form the grooves or splines on the inside surface of the hollow body and use a smooth-surfaced pushrod in combination with the grooved (splined) hollow body, which accomplishes the same purpose. See FIG. 9. In both cases, the grooves or splines are aligned with orifices or ports in the head and tail pieces to permit the fluids to flow in (ingress), through, and out (egress) of the bypass plunger when the plunger is in an "open" condition and is descending into the well bore. See FIG. 10. When the plunger reaches the end of the well bore, the pushrod is forced upward within the plunger to seat a valve head against a seat within the body. This action blocks the fluid passages in the plunger by placing it in the "closed" condition, thus allowing the plunger to function as a piston to lift the fluids above it toward the surface. See FIG. 2.

In yet another (fourth) embodiment the head and tail pieces respectively include ports for the egress and ingress of fluids that pass through the plunger while descending through a well bore. The ports in the head and tail pieces are aligned with the passages of the third embodiment within the hollow body of the plunger to enable the flow of fluids through the plunger when a valve within the plunger is open. These ports or orifices may be angled and shaped to enhance the fluid flow through them. See FIG. 11. The four embodiments described and illustrated herein may be used alone or in combination, depending on the particular utility required.

Briefly, the full-perimeter crimp (first) embodiment, also called a "360 crimp" herein, is disposed within a shallow external recess or circumferential groove surrounding the skirts of the head and tail pieces. The external circumferential recess is centered on the same diameter of the head or tail piece as a similar ("internal") circumferential recess that surrounds the threaded outside of the upper (or lower) end of the hollow body. The upper (first) and lower (second0 ends of the hollow body respectively connect to the head (tail) pieces of the bypass plunger. A plane perpendicular to the longitudinal axis of the plunger passes through the center of the 360 crimp, as well as the mid-point diameters of the external and internal circumferential grooves. The 360 crimp, which can be formed in a roll crimping operation—a cold forming process—around the skirt of the head piece or tail piece, forces material of the internal bore of the head or tail piece inward into the internal circumferential recess or groove in the threaded end portion(s) of the hollow body, thus forming a ring of material of the respective head or tail piece that protrudes into the internal groove and permanently clamps or crimps the head piece (tail piece) to the respective end of the hollow body. The external circumferential recess reduces the wall thickness of the head or tail piece to facilitate the deformation of its wall material into the internal circumferential recess of the respective end of the hollow body. This structure eliminates the need for pins or screws to prevent the threaded portions from turning or loosening. It also eliminates hand operations associated with manufacture and repair of plunger using pins or screws to lock the threaded parts together. See FIGS. 4 and 5.

Figure 5:
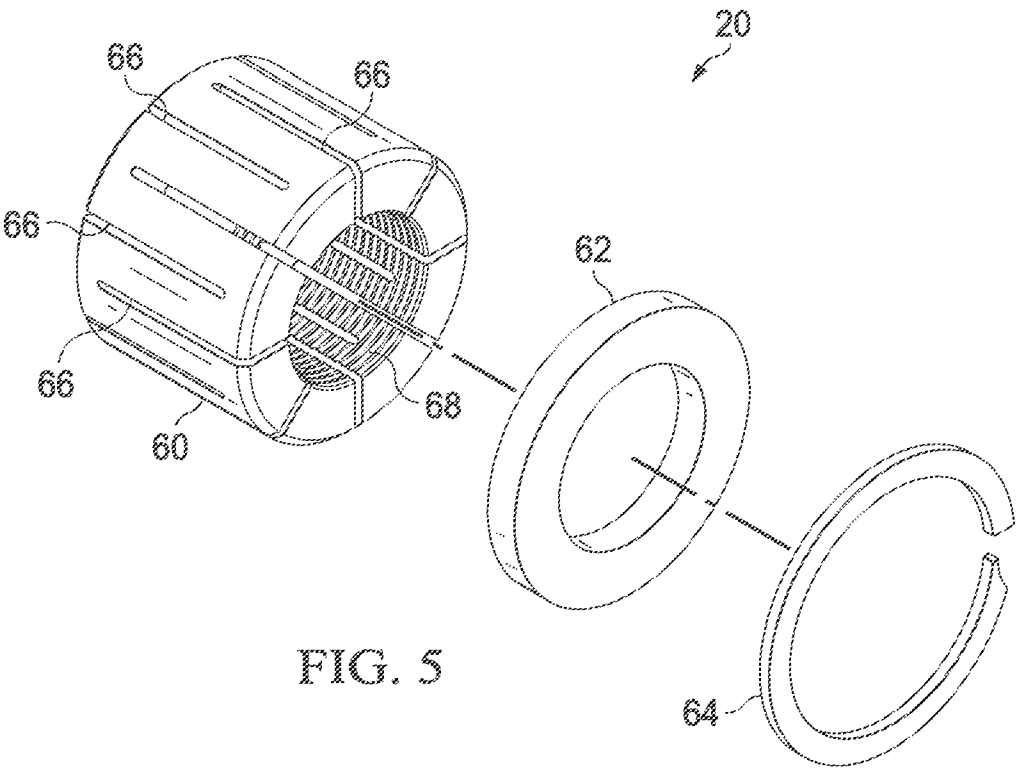
FIG. 5 illustrates an exploded perspective view of an embodiment of a clutch assembly for use in the embodiment of FIG. 1.
Figure 6:
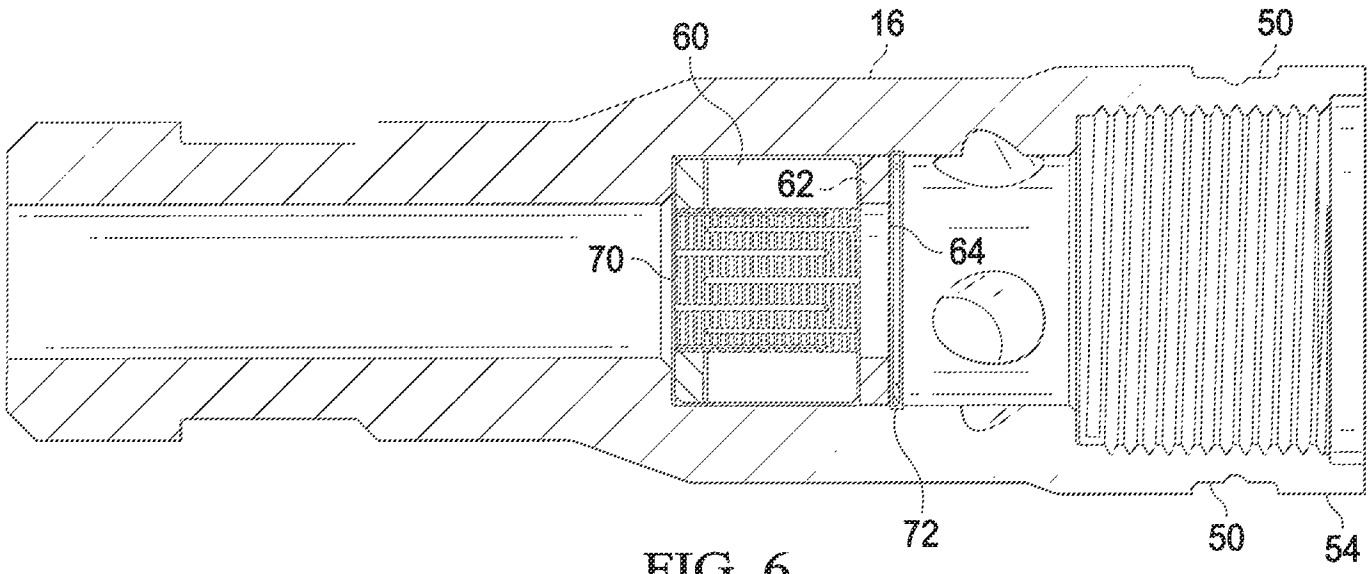
FIG. 6 illustrates a cross section view of the clutch assembly of FIG. 5 installed in a head piece of the embodiment of FIG. 1.

The (second) one piece clutch embodiment comprises a collet having a plurality of kerfs (slots or saw cuts) sequentially cut from alternate ends of the collet. The alternating kerfs in the walls of the collet provide the flexibility to allow the body of the collet to stretch slightly to grip the pushrod and restrain it from sliding through the clutch. The number, width, depth, and spacing of the kerfs may be varied to adjust the tension the collet exerts on the stem of the pushrod. The collet is secured within the head piece by a shield washer and a split ring. The collet, shield washer, and split ring together form a clutch assembly as shown in FIG. 5 (and also FIG. 1). The split ring is secured within a groove within the head piece of the plunger as shown in FIG. 6.

The collet is formed with an internal diameter that is slightly smaller than the outside diameter of the stem at the upper end of the pushrod, to provide an interference fit about the rough surfaced (A circumferentially grooved, knurled, etched, or threaded) shaft of the pushrod. The combination of a slightly undersized collet and a roughened surface of the stem provides the friction necessary to hold the pushrod and its valve in the respective open or closed positions. The threshold to permit sliding is set by the amount of undersize of the inside diameter of the collet. In one example the amount of the undersize diameter is in the range of 0.0005 to 0.002 inch, which provides enough friction to hold the pushrod in position yet permit it to slide to change the plunger between the open and closed positions. The pushrod is permitted to slide within the clutch when the plunger impacts the bumper spring at the bottom of the well bore or a stop apparatus at the surface. The sliding repositions the pushrod in the plunger respectively to ascend or descend through the well bore by closing or opening the flow passages. With suitable modification to the tailpiece, this clutch design may also be used within the tailpiece.

Figure 9:
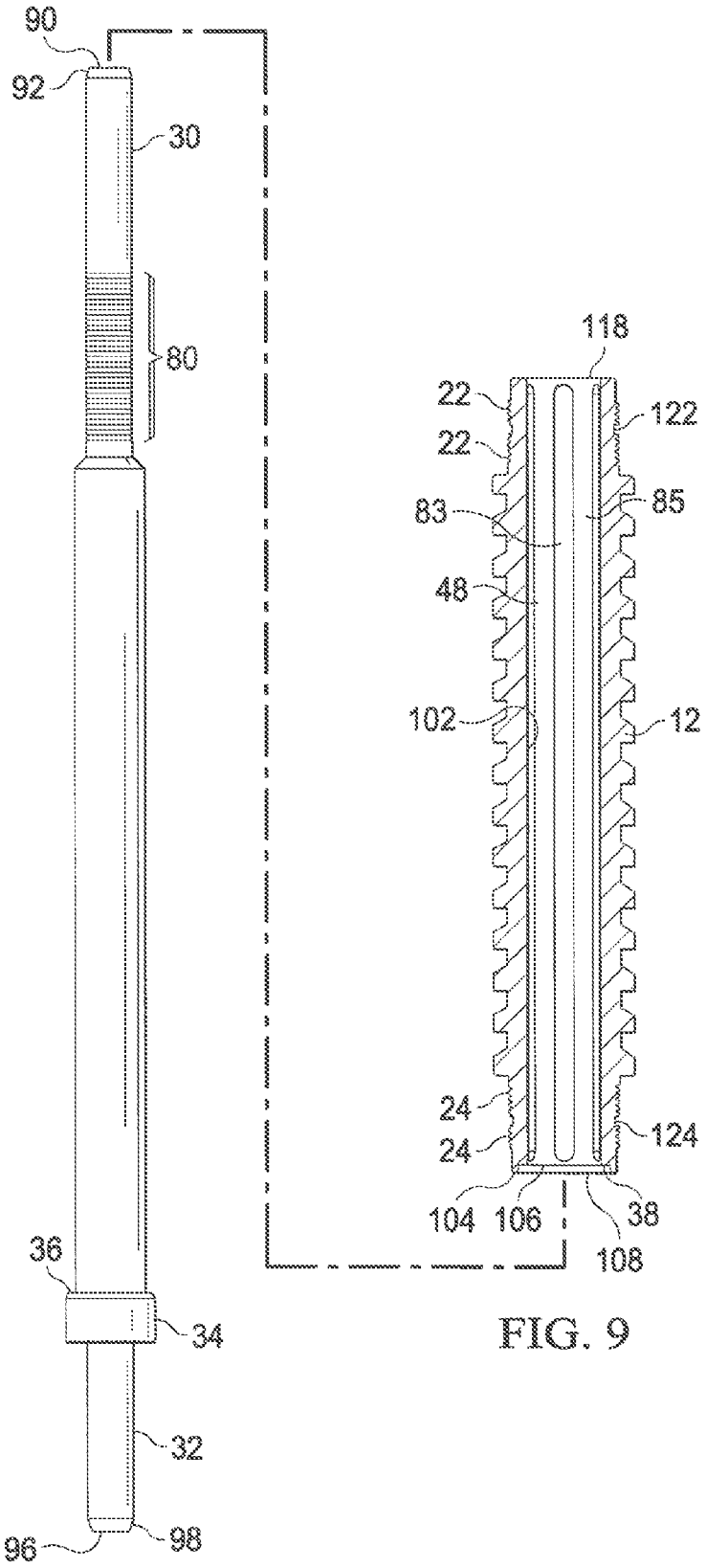
FIG. 9 illustrates the pushrod and hollow body portions of the embodiment of FIG. 1 that depict a second aspect of longitudinal grooves formed in the interior surface of the hollow body portion of the bypass plunger.
Figure 10:
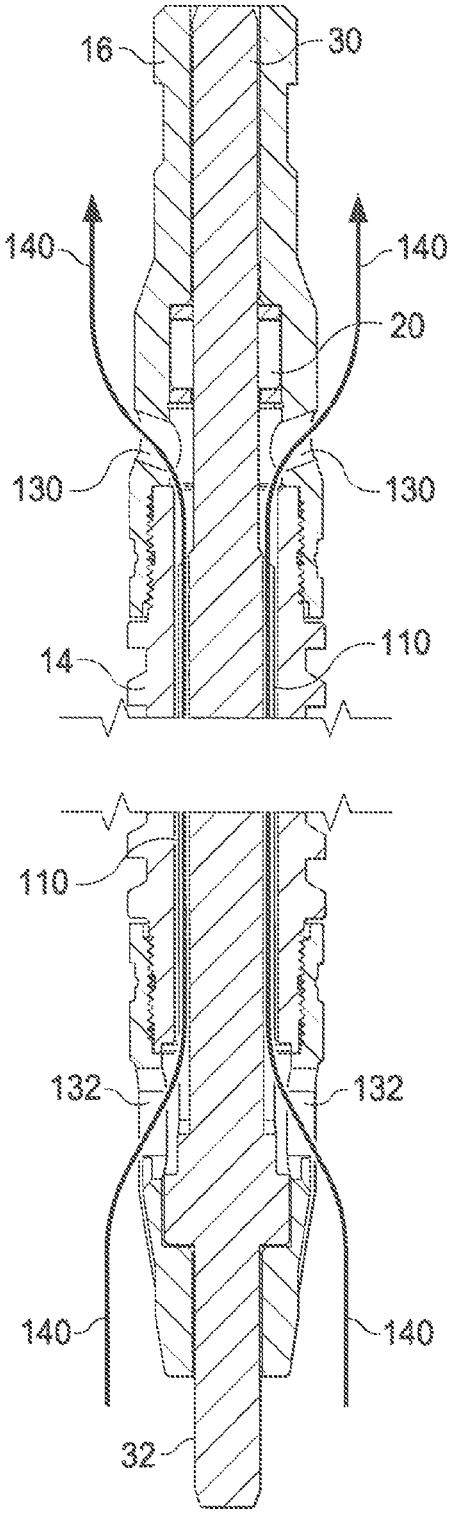
FIG. 10 illustrates a cross section view of an assembled bypass plunger according to the embodiment of FIG. 1 shown in an open configuration and depicting the path of fluid flowing through the bypass plunger as it descends through a well bore.

The third embodiment comprises the longitudinal grooves within the plunger that are formed in the outer surface of the mid-section of the pushrod or the internal bore of the hollow body of the plunger. These longitudinal grooves or splines provide the fluid passages through the plunger as it descends through the well bore, as shown in FIGS. 8, 9 and 10.

Figure 11:
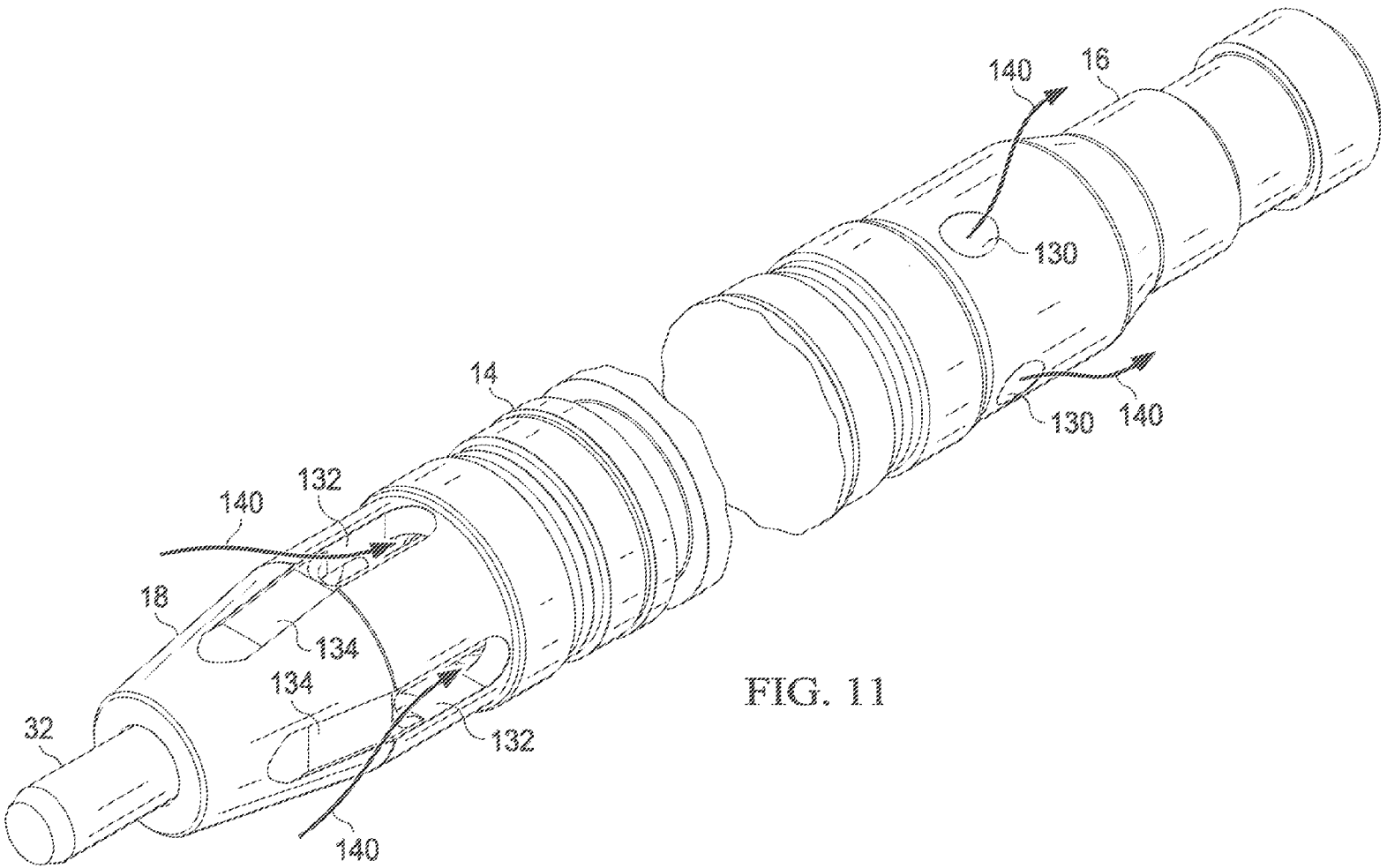
FIG. 11 illustrates a perspective view of the head piece and tail piece portions of the bypass plunger according to the embodiment of FIG. 1 depicting ingress and egress paths of fluid during descent through a well bore.

A fourth embodiment includes shaping the entry and exit fluid passages of the head and tail pieces of the plunger, as depicted in FIG. 11. These ports, typically three or four openings or passages that may be disposed at equal angular intervals around the head and tail pieces, may be cut at an angle relative to the longitudinal axis of the plunger through the body wall of the plunger. In related embodiments, the ports may also be shaped to provide an obstacle-free passage for the flow of fluids.

The foregoing embodiments may be used alone or in combination in a variety of bypass plunger tools that employ the basic hollow cylindrical body and pushrod/valve configuration. The variations in such plungers often (but not exclusively) affect the external or outer surfaces of the hollow body portion of the plunger and the materials used in the hollow body portion of the tool. A variety of concentric or helical rings, disposed full length or in groups along the outside of the hollow body may be used to provide sealing effects of the body of the plunger to the inside wall of the well casing, or impart or limit various modes of motion to the plunger as it travels through the well bore. Other designs may have sets of cylindrical segments disposed on the outer surfaces of the plunger body that are biased radially outward to maintain sealing contact with the well casing during ascent.

The accompanying drawings illustrate one example of a bypass plunger according to the present invention and several embodiments thereof. Persons skilled in the art will recognize that variations of the embodiments depicted in the drawings are possible without departing from the scope of the inventions set forth in the claims. In the drawings, reference numbers appearing in more than one figure identify the same structural feature.

FIG. 1 illustrates an exploded view of a bypass plunger 10, which depicts the basic plunger construction and several embodiments thereof according to the present invention. The plunger 10 assembly includes a hollow cylindrical body 12 (alternately herein, hollow body 12), a pushrod 14 (alternately a shift rod or main shaft 14), a head piece 16, and a tail piece 18. A clutch assembly 20 may be disposed within the head piece 16 (or the tail piece 18) when the plunger 10 is assembled. The hollow body 12 includes external screw threads at a first end 23 and a second end 25. The screw threads 22 mesh with internal screw threads 26 formed in the skirt end of the head piece 16. The screw threads 24 mesh with the internal screw threads 28 formed in the skirt end of the tail piece 18. The pushrod 12 includes, in order, a first end stem 30, a mid-section 58, a valve head 34 to be described, and a second end stem 32. Upon assembly of the plunger 10, the pushrod 14 (primarily the mid-section 58 thereof) may be disposed within the hollow body 12 and retained in the hollow body 12 by the headpiece 16 and the tail piece 18. The first end stem 30 extends through the headpiece 16 and the second end stem 32 extends through the tailpiece 18 as shown in FIGS. 2 and 3 to be described.

Figure 2:
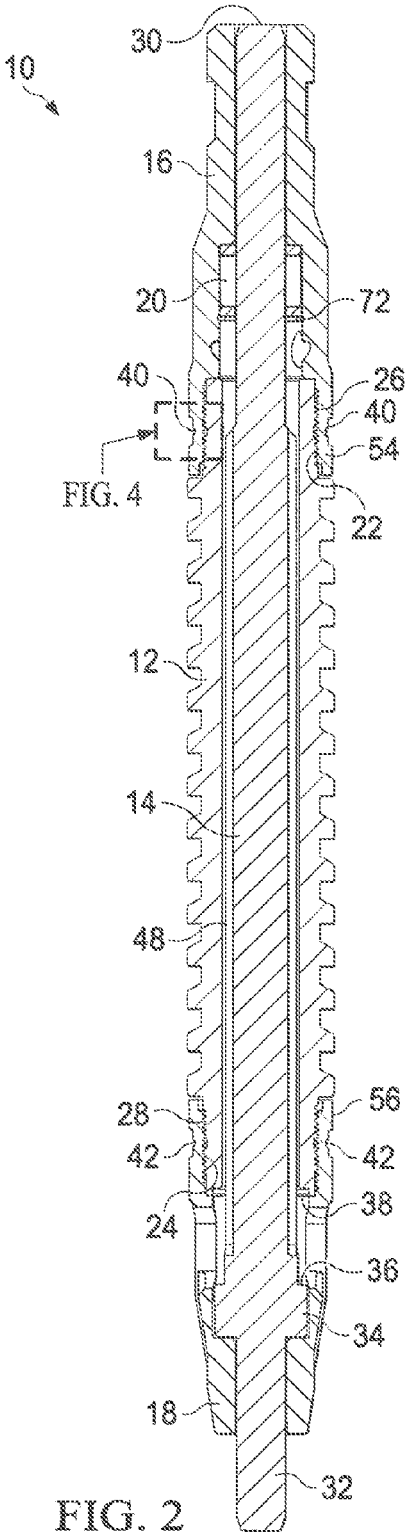
FIG. 2 illustrates a cross section view of an assembled bypass plunger of FIG. 1 shown in an open configuration for ascent through a well bore.
Figure 3:
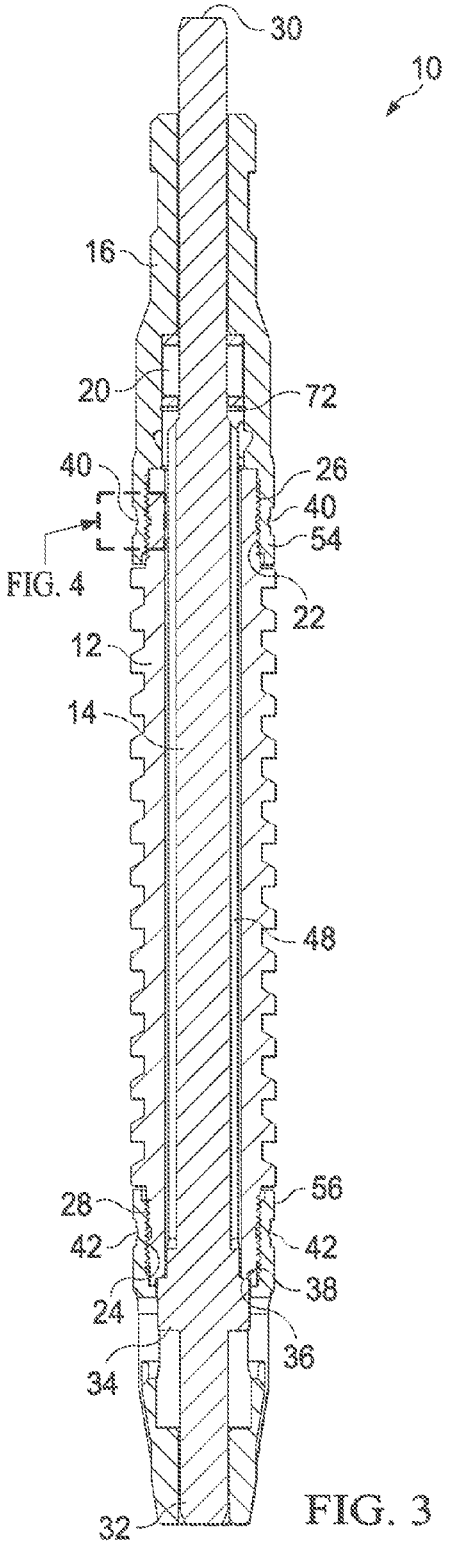
FIG. 3 illustrates a cross section view of an assembled bypass plunger of FIG. 1 shown in a closed configuration for descent through a well bore.

FIGS. 2 and 3 are identical except that FIG. 2 depicts the bypass plunger 10 in an open configuration for descent through a well bore and FIG. 3 depicts the plunger 10 in a closed configuration for ascent through a well bore. The bypass plunger 10 is shown in a cross section along the longitudinal axis in both figures, depicting the pushrod 14 installed within the hollow body 12 and retained therein by the headpiece 16 and the tailpiece 18, which may be respectively threaded onto the hollow body 12 at screw threads 22, 26 and 24, 28. The clutch assembly 20 is shown installed in the headpiece 30 and on the first end stem 30, an extension of the pushrod 14 that extends through the headpiece 16.

Figure 4:
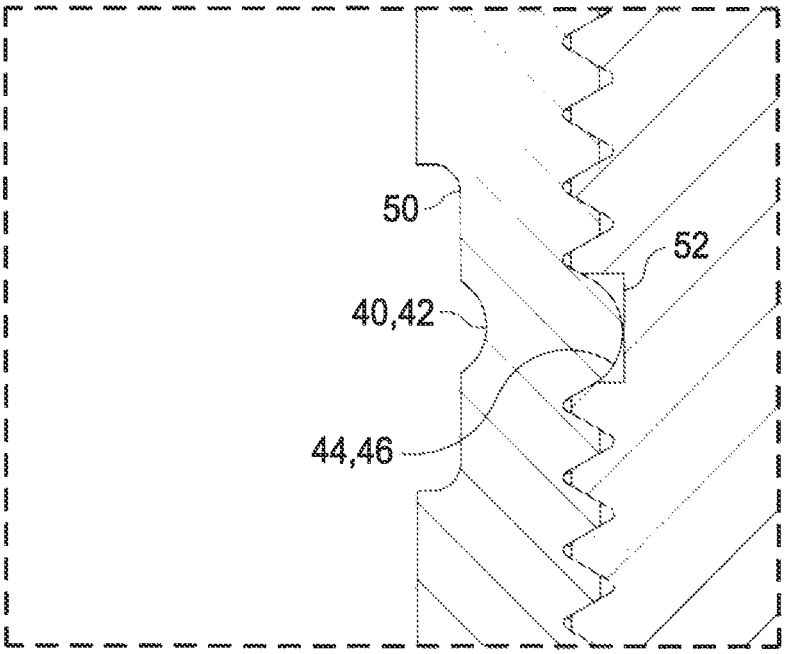
FIG. 4 illustrates a detail of one embodiment of the bypass plunger of FIG. 1 showing a cross section of a full-perimeter crimp.

Continuing with FIGS. 2 and 3, and also FIG. 4, the feature for locking the head 16 and tail 18 pieces to the hollow body 12 will be described. FIG. 4 depicts details of the structure of the circumferential recesses that enable the 360 degree crimp embodiment of the present invention. The pairs of recesses as formed into the head and tail pieces 16, 18 and each threaded end of the hollow body 12 are the same in the illustrated example. Surrounding the skirt 54 of the head piece 16—the portion of the headpiece that is internally threaded—is an external circumferential recess 50 formed in the outer surface of the skirt 54. This recess 50 may be 0.375" wide×0.050" deep. Similarly, cut into the external threads 22 of the first end 23 of the hollow body 12, is a similar but smaller internal circumferential recess 52, disposed on coincident diameters of the hollow body 12 and headpiece 16 so that when the headpiece 16 is installed on the hollow body 12, the external and internal circumferential recesses 50, 52 are juxtaposed, one over the other. The second circumferential recess 52 may be cut to 0.125" wide×0.060" deep.

To complete the assembly of the bypass plunger 10, the hollow body 12 of the bypass plunger 10, with the head 30 and tail 32 pieces installed on the respective ends 23, 25 of the hollow body, the assembled plunger body is placed in a roll crimping apparatus (not shown). The roll crimping apparatus produces a 360 degree circumferential crimp 40 is formed into the skirt 54 of the headpiece 16, deforming the metal of the skirt 54 so that it protrudes into the internal circumferential recess 52, extending a crimped ridge 44 into the threads 22 on the first end 23 of the hollow body 12. The crimped ridge 44 acts to lock the threaded joint between the head piece 16 and the hollow body 12, obviating the need for set screws, retaining pins or other additional components to prevent the threaded join from loosening. The crimping operation is relatively fast and simple, requiring no additional parts or operations to complete, thereby reducing manufacturing costs.

Continuing with FIGS. 2, 3, and 4, a 360 crimp circumferential crimp 42 that forms a second circumferential ridge 46 into the threaded joint 24, 28 of the assembled bypass plunger 10 is achieved in an identical manner to lock the tailpiece 18 to the second end 25 of the hollow body 12. Surrounding the skirt 56 of the tailpiece 18—the portion of the tailpiece 18 that is threaded—is an external circumferential recess 50 formed in the outer surface of the skirt 56. This recess 50 may be 0.375" wide×0.050" deep. Similarly, cut into the external threads 24 of the second end 25 of the hollow body 12, is a similar but smaller internal circumferential recess 52, disposed on coincident diameters of the hollow body 12 and tailpiece 18 so that when the tailpiece 18 is installed on the hollow body 12, the external and internal circumferential recesses 50, 52 are juxtaposed, one over the other. The internal circumferential recess 52 may be cut to 0.125" wide×0.060" deep.

When the assembled plunger body is placed in the roll crimping apparatus (not shown), a 360 degree circumferential crimp 42 is formed into the skirt 56 of the tailpiece 18, deforming the metal of the skirt 56 so that it protrudes into the internal circumferential recess 52, extending a crimped ridge 46 into the threads 24 on the second end 25 of the hollow body 12. The crimped ridge 46 acts to lock the threaded joint 24, 28 between the tailpiece 18 and the hollow body 12, obviating the need for set screws, retaining pins or other additional components to prevent the threaded join from loosening. FIG. 4 illustrates a cross section detail of the full-perimeter 360 degree crimp formed in both the headpiece 16 and tailpiece 18 to secure them form loosening.

Also shown in FIGS. 2 and 3 is the disposition of the pushrod 14 within the hollow body 12 in the open (FIG. 2) and closed (FIG. 3) positions. At the lower end of the pushrod 14, between the pushrod body 58 and the second end stem 32 is a valve head 34. The valve head 34 is a contiguous part of the pushrod 14 having a larger diameter that forms a shoulder 36 at the inward end of the valve head 34. The shoulder 36 is configured as a face to contact a valve seat 38 formed within the lower, second end 25 of the hollow body 12. When the pushrod 14 is in an open position (FIG. 2), the valve head 34 and its shoulder 36 are disposed away from the valve seat 38, thus permitting fluids to pass through the passages 130, 132, 110 formed in the head and tail pieces 16, 18 (See FIGS. 10, 11), and bypass plunger 10 as will be described in FIGS. 10, and 11 herein. When the pushrod 14 is in a closed position (FIG. 3), the face 36 of the valve head 34 is disposed in contact with the valve seat 38, thus blocking fluids from passing through the passages 130, 132, 110 formed in the head and tail pieces 16, 18, and bypass plunger 10.

FIG. 5 illustrates an exploded perspective view of an embodiment of a clutch assembly 20 according to the present invention. The clutch assembly 20 includes a collet 60, a sealing washer 62, and a split ring retainer 64. The sealing washer 62 functions to block fine grained debris carried by fluids passing through the bypass plunger from becoming lodged in the clutch kerfs 66 and impairing the function of the clutch. The split ring retainer, which fits into a groove 72 (See FIG. 6) machined into the bore of the headpiece 16, retains the collet 60 of the clutch and sealing washer 62 in place within the headpiece 16. In the description of the clutch herein, the same reference number that identifies the collet 60 also identifies the clutch because the clutch (functional name) and the collet (objective name) are the same component.

The clutch itself is formed as a single component—the collet 60 having a short cylindrical body, an outside diameter, and a bore with an inside diameter. The walls of the collet 60—the body of the clutch—include a plurality of kerfs 66 (or saw cuts) oriented parallel with the longitudinal axis or centerline of the collet 60 (which is coincident with the longitudinal axis of the bypass plunger 10 and pushrod 14). The kerfs 66 extend more than half the distance from one end of the collet 60 to the other end. Further, the kerfs 66 are cut from the opposite ends of the collet 60 in an alternating sequence as shown in FIGS. 5 and 6. The outside diameter of the clutch plus a clearance dimension is equal to the inside diameter of the headpiece 16. The inside diameter of the collet 60 is preferably slightly undersize, i.e., less than the outside diameter of the first end stem 30 of the pushrod 14, such that when the pushrod 14 is inserted into the assembled headpiece 30 and clutch assembly 20, the interference fit between the collet 60 and the first end stem 30 enables the collet 60 to grip the first end stem 30. The amount of the undersize may preferably be in the range of 0.0005 to 0.002 inch in the illustrated example.

In operation of the clutch, the collet 60, because of the flexibility provided by its alternating kerf structure, is permitted to stretch slightly to provide the necessary tension around the first end stem 30. The resulting friction that enables the grip of the collet 60 on the first end stem 30 may be enhanced by a surface finish 80 applied to the first end stem 30 and the inside bore 68 of the collet 60. The surface finish of the inside bore 68 may be provided by circumferential grooves, knurling, etching, or threads as is well understood in the art. A preferred surface is the same as described for FIG. 8B herein.

FIG. 6 illustrates a cross section view of the clutch assembly 20 installed in a head piece 16 of the bypass plunger 10 of the present invention, but without the pushrod 14 in place to show the detail more clearly. The view along the longitudinal axis depicts the headpiece 16, its skirt 54, and the clutch assembly 20 installed in the headpiece 16. The collet 60 is placed in the headpiece, followed by the sealing washer 62, and the split ring 64 seated in the groove 72 to retain the clutch assembly 20 in place. The collet 60 may be formed of a variety of stainless steels or other alloy steels, heat treated carbon steels, molybdenum-filled nylon, Nyloil or titanium alloys. Materials that resist harsh conditions and chemicals encountered in down-hole environments that can cause excessive wear or corrosion should be avoided. One preferred material, because of its excellent resistance to galling—a deterioration of metal surfaces that slide together under pressure—is called Nitronic 60®, a product of Electralloy manufactured under license form Arrnco Inc. The pushrod may be manufactured from a variety of stainless steels, including type 17-4 stainless Steel, a preferred material. Other suitable materials include Nitronic 60® and heat treated carbon steels or titanium.

Figure 7:
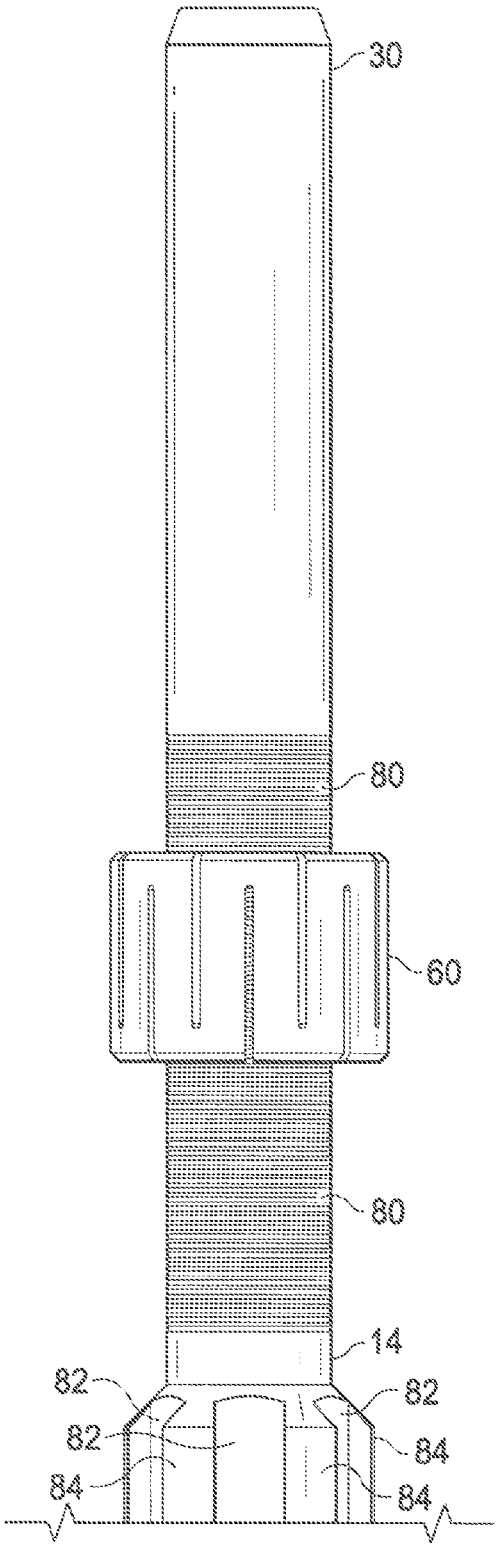
FIG. 7 illustrates a side view of a one piece collet clutch installed on a stem extension of a pushrod portion of the bypass plunger of the embodiment of FIG. 1.

FIG. 7 illustrates a side view of the clutch collet 60 installed on the first end stem 30 of a pushrod 14 of the bypass plunger 10, to show the relationship of the clutch assembly 20 and the first end stem 30. This view also depicts the roughened surface finish 80 applied to the surface of the first end stem 30 of the pushrod 14. The surface finish 80 may be circumferentially grooved, knurled, etched, or threaded. The preferred finish, as shown in FIG. 7 and in detail in FIG. 8B to be described, is to form shallow ridges and grooves having the same fillet radius on both the top and bottom peaks to provide a ratcheting effect. The pitch of the grooves 80—the number of grooves per inch—may be varied according to the fillet radius used to form the ridges and grooves, to adjust the gripping tension provided by the collet 60 of the clutch assembly 20. FIG. 7 also illustrates spline grooves 82, formed in the surface 84 of the pushrod 14, to be described in FIGS. 8A and 8B.

Figures 8A, 8B:
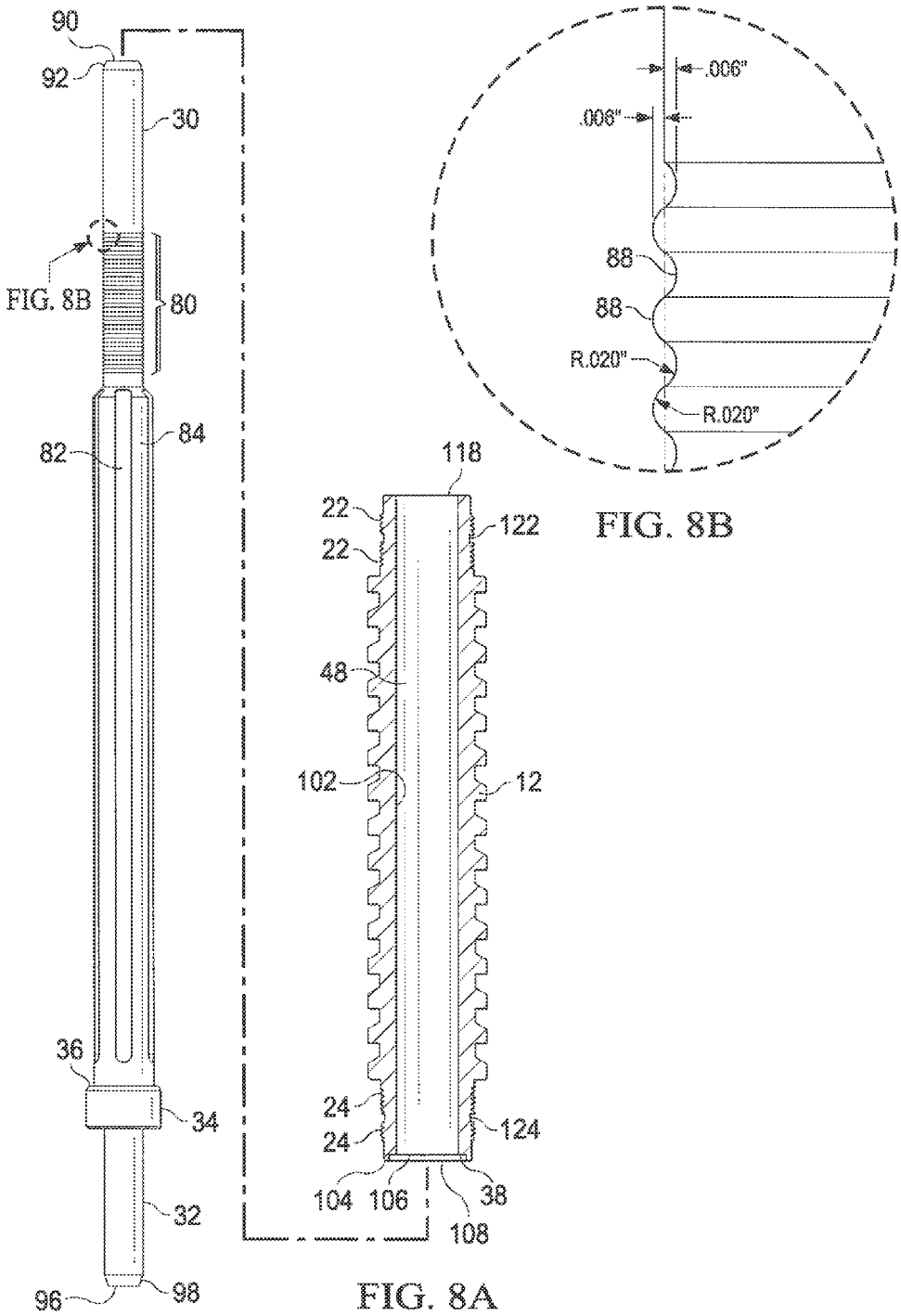
FIG. 8A illustrates the pushrod and hollow body portions of the embodiment of FIG. 1 that depict a first aspect of longitudinal grooves formed in the exterior surface of the pushrod portion of the bypass plunger.
FIG. 8B illustrates a detail cross section view of the surface of a stem extension of the pushrod portion of the bypass plunger of the present invention.

FIG. 8A illustrates the pushrod 14 and hollow body 12 portions of the bypass plunger 10 of a first (alternative) aspect of longitudinal grooves or splines 82 formed in the exterior surface 84 of the pushrod 14. The nominal dimensions of the grooves are 0.265" wide×0.050" deep. These dimensions may be varied to adapt to specific applications. In the illustrated embodiment six grooves 82 are uniformly spaced around the pushrod 14. The grooves or splines 82 formed in the surface 84 of the pushrod 14 provide internal passages (flow-by grooves) along the length of the plunger 10 for fluids to flow during the descent of the bypass plunger 10 through the well bore to the bottom or distal end of the well bore. Other structures indicated by reference numbers are the same as described previously.

Additional features shown in FIG. 8A include a taper 92, 98 formed at the respective ends of the first 30 and second 32 end stems of the pushrod 14. The end faces 90, 96 of the end stems 30, 32 are also identified. The tapers (or chamfers) 92, 98 are provide to allow for mushrooming of the end faces 90, 96 of the pushrod 14. FIG. 8A includes a cross section view of the hollow body 12 of the bypass plunger 10. The longitudinal bore 48 is shown as a smooth cylindrical surface 102, which, together with the splines 82 formed in the surface 84 of the pushrod 14 form the internal fluid passages 110 (See FIG. 10) within the bypass plunger 10.

FIG. 8A identifies the upper end 118 of the hollow body 12 and the second, lower end 108 of the hollow body 12. The second end 108 may be counterbored at 104 as shown to provide OD (outside diameter) clearance to receive the face 36 of the valve head 34 when the pushrod 12 is configured in the (valve) closed condition during the ascent of the plunger 10. In the closed position, the face 36 of the valve head 34 may be seated against the valve seat 38 within the hollow body 12. A small sealing taper 106 may be provided for sealing the valve head 34 in its closed position. Other features of the hollow body 12 shown in FIG. 8A are the external threads 22, 24 on each end of the hollow body 12 and the internal circumferential recesses 122, 124 that encircle the mid-section of each of the threads 22, 24.

FIG. 8B illustrates detail of one preferred surface finish 80 applied to the first end stem 30 of the pushrod 14, where the clutch assembly 20 resides in the assembled plunger 10. Shown are a plurality of uniformly-spaced circumferential ridges and grooves 88 that alternate along the surface finish 80. The series of ridges and grooves 88 may be shown in cross section as arcs of a circle having a radius of 0.020" and a height relative to a centerline (the nominal diameter of the first end stem 30) of 0.006". The pitch of the ridges and grooves that provide the surface finish 80—the number of grooves per inch—may be varied according to the fillet radius used to form the ridges and grooves. Thus the dimensions of the ridges and grooves 88 may be varied to adjust the gripping tension provided by the collet 60 of the clutch assembly 20 when installed on the first end stem 30.

FIG. 9 illustrates the pushrod 14 and hollow body 12 portions of the bypass plunger 10 of a second (alternative) aspect of longitudinal grooves or splines formed in the interior surface of the hollow body 12 for use with a pushrod 14 that is formed with no grooves or splines in its outer surface 84. The nominal dimensions of the grooves 83, formed in the surface 102 of the internal bore 48 of the hollow body 12, are preferably 0.265" wide×0.050" deep. These dimensions may be varied to adapt to specific applications. In the illustrated embodiment it is preferred that six grooves 83 are provided around the interior bore 48 of the hollow body 12. The splines 85 thus formed on the surface 102 of the internal bore 48 of the hollow body 12, in conjunction with a smooth outer surface 84 of the pushrod 14 together provide internal passages (flow by grooves) along the length of the plunger 10 for fluids to flow during the descent of the bypass plunger 10 through the well bore to the bottom or distal end of the well bore.

Additional features shown in FIG. 9 include a taper or chamfer 92, 98 formed at the respective ends of the first 30 and second 32 end stems of the pushrod 14. The end faces 90, 96 of the end stems 30, 32 are also identified. The tapers (or chamfers) 92, 98 may be provided to allow for mushrooming of the end faces 90, 96 of the pushrod 14. FIG. 9 also identifies the upper end 118 of the hollow body 12 and the second, lower end 108 of the hollow body 12. The second end 108 may be counterbored at 104 as shown to provide OD (outside diameter) clearance to receive the face 36 of the valve head 34 when the pushrod 12 is configured in the (valve) closed condition during the ascent of the plunger 10. In the closed position, the face 36 of the valve head 34 may be seated against the valve seat 38 within the hollow body 12. A small sealing taper 106 may be provided for sealing the valve head 34 in its closed position. Other features of the hollow body 12 shown in FIG. 9 are the external threads 22, 24 on each end of the hollow body 12 and the circumferential recesses 122, 124 that encircle the mid-section of each of the threads 22, 24.

FIG. 10 illustrates a cross section view of one embodiment of an assembled bypass plunger 10 according to the present invention shown in an open configuration and depicting the path of fluid flowing through the bypass plunger 10 as it descends through a well bore. The path 140 enters (called "ingress") tailpiece ports 132, flows through the plunger's hollow body via the splined region as described for FIGS. 8 and 9, and exits (called "egress") through the headpiece ports 130. In this configuration, the pushrod 14 is disposed in its open position because the valve head 34 is disposed away from the valve seat 38. Further, the pushrod 14 is retained in this position by the gripping action of the clutch assembly 20.

When the descent reaches the bottom or distal end of the well bore, the second end stem 32 contacts the bumper (not shown) at the well end, causing the pushrod 14 to overcome the tension exerted on the first end stem 30 by the clutch assembly 20 and move upward within the hollow body 12 of the bypass plunger 10, thereby closing the valve 34 by seating its face 36 against the valve seat 38 to prevent further flow of fluids from the well through the bypass plunger 10. When the valve 34 is closed against its seat 38, the clutch assembly 20 retains the first end stem 30 of the pushrod in its uppermost orientation until released by a stop apparatus (not shown) at the surface of the Earth. As is well known, pressures that build within the wellbore, which are effectively blocked by the plunger body, will cause the bypass plunger 10 to move upward, carrying fluids produced by the well or other substance upward toward the surface.

FIG. 11 illustrates an external perspective view of the head piece 16 and tail piece 18 portions of the bypass plunger 10 according to the present invention. This view depicts the ingress and egress paths 140 of fluid during descent through a well bore. The assembled bypass plunger 10 is shown with the second end stem 32 of the pushrod 14 protruding from the lower end of the tailpiece 18 at the second end of the hollow body 12. The ingress ports 132 through the wall of the tailpiece 18 at several radial locations around the tailpiece 18 are shown, as are several egress ports 130 through the wall of the headpiece 16. The flow path 140, as shown internally in FIG. 10 is shown externally in FIG. 11. Considering FIGS. 10 and 11 together, the fluid flows into the ingress ports 132, through the passages 110 in the body of the bypass plunger 10 and out through the egress ports 130 as the plunger descends through the well bore. As noted previously, the dimensions and configurations of the fluid passages may be varied to adapt to the specific application.

The ingress ports 132 may be uniformly spaced at three or four radial positions around the tailpiece 18. The egress ports 130 may be uniformly spaced at two, three, or four radial positions around the headpiece 16. In general, the ports 132, 130 may be formed as angled holes through the wall of the tailpiece or headpiece, wherein the angle of the centerline of the ports is an acute angle relative to the longitudinal centerline of the bypass plunger 10 and oriented from within the bypass plunger outward toward the well bore. The ingress and egress ports 132, 130 may further be shaped to minimize obstruction to the flow of fluid through them. Other techniques to control the late of descent include varying the cross sectional area, or the angular orientation of, the ports 132, 130 themselves.

While the inventions have each been shown in only one of their respective forms, the inventions are not thus limited but are susceptible to various changes and modifications without departing from the spirit thereof. The dimensions of the bypass plunger and its component parts described herein may be scaled for use with various sizes of well bore casings, for the expected rates of flow need to efficiently reactivate a dormant well or to remove fluids from the well and enable improved production.

What claimed is:

1. A bypass plunger, comprising:

a hollow cylindrical body having a longitudinal bore therethrough and external threads at first and second opposite ends for respectively receiving a head piece and a tail piece, the external threads including a first preformed 360 degree recess disposed around a mid-point thereof;

a one piece pushrod configured as a shaft having a first end stem, a second end stem, a mid-section between the first and second end stems, and an enlarged valve head disposed between the mid-section and the second end stem, wherein the pushrod is slidably disposed within the longitudinal bore of the hollow cylindrical body between an open state and a closed state of the valve head against an internal valve seat at the second opposite end of the hollow cylindrical body;

the head piece having a longitudinal bore therethrough for receiving the first end stem of the pushrod and internal threads at a lower end skirt thereof for attachment to the external threads of the first end of the hollow cylindrical body, the lower end skirt including a second 360 degree recess around its outer surface and aligned with the midpoint of the internal threads; and the tail piece having a longitudinal bore therethrough for receiving the second end stem of the pushrod and internal threads at an upper end skirt thereof for attachment to the external threads of the second end of the hollow cylindrical body, the upper end skirt including a third 360 degree recess around its outer surface and aligned with the midpoint of the internal threads; wherein the head and tail pieces are secured to the hollow cylindrical body by a 360 degree crimp that deforms the skirts of the head and tail pieces into the first 360 degree preformed recess in the external threads of the hollow cylindrical body; and wherein the valve head of the pushrod is retained within the tail piece.

2. The bypass plunger of claim 1, wherein: the width of the first preformed recess disposed around the midpoint of the external threads at the first and second ends of the hollow cylindrical body is less than the width of the circumferential recesses in the head piece and the tail piece.

3. The bypass plunger of claim 1, wherein: the depth of the preformed recesses does not exceed one-half the wall thickness of the respective hollow body, head piece, or tail piece.

4. The bypass plunger of claim 1, further comprising: a radial inward crimp formed within the second preformed recess disposed around the skirt of the head piece.

5. The bypass plunger of claim 1, further comprising: a radial inward crimp formed within the third preformed recess disposed around the skirt of the tail piece.

6. The bypass plunger of claim 1, further comprising:
a clutch assembly disposed within the internal bore of the head piece.

7. The bypass plunger of claim 6, the clutch assembly comprising:
a one piece clutch configured as a collet;
a shield washer; and
a retaining ring.

8. The bypass plunger of claim 7, wherein the one piece clutch comprises:
a collet having an outside diameter smaller than the inside diameter of the head piece and an inside diameter slightly smaller than the diameter of the first end stem; and
a plurality of kerfs cut in sequence from alternate ends of the cylindrical body.

9. The bypass plunger of claim 8, wherein:
the outside diameter of the collet is larger than the length of the collet.

10. The bypass plunger of claim 8, wherein:
the inside diameter of the collet is less than the diameter of the first end stem by at least 0.0005 inch.

11. The bypass plunger of claim 6, further comprising:
a surface finish disposed substantially along the first end stem of the pushrod and selected from the group consisting of a knurled pattern, closely-spaced concentric grooves, screw threads, and an etched pattern.

12. The bypass plunger of claim 1, further comprising:
a plurality of uniformly-spaced splines are formed into the surface of the mid-section of the pushrod; wherein
a predetermined clearance is provided between the splines and the internal bore of the hollow body.

13. The bypass plunger of claim 12, wherein:
the predetermined clearance is at least 0.030 inch.

14. The bypass plunger of claim 12, wherein:
the number of uniformly-spaced splines is at least four.

15. The bypass plunge of claim 12, wherein:
the height of the splines relative to the surface of the pushrod is less than 0.060 inch.

16. The bypass plunger of claim 1, further comprising:
a plurality of uniformly-spaced splines are formed into the surface of the internal bore of the hollow body; wherein
a predetermined clearance is provided between the splines and the surface of the mid-section of the pushrod.

17. The bypass plunger of claim 16, wherein:
the predetermined clearance is at least 0.030 inch.

18. The bypass plunger of claim 16, wherein:
the number of uniformly-spaced splines is at least four.

19. The bypass plunger of claim 16, wherein:
the height of the splines relative to the surface of the internal bore of the hollow body is less than 0.060 inch.

20. The bypass plunger of claim 1, wherein the head pieces comprise:
a plurality of egress ports disposed through the wall of the head piece and uniformly spaced therearound.

21. The bypass plunger of claim 1, wherein the tail pieces comprise:
a plurality of ingress ports disposed through the wall of the tail piece and uniformly spaced therearound.

22. A clutch for use in a bypass plunger formed of an assembly of a main shaft slidingly disposed within a hollow cylindrical body capped at first and second ends by respective hollow head and tail pieces, comprising:
a collet configured for frictionally holding the main shaft within either the head piece or the tail piece and having a plurality of kerfs cut in sequence from alternate ends thereof; and
an inside diameter slightly smaller than the outside diameter of the main shaft.

23. The clutch of claim 22, wherein:
at least one of the main shaft and the inside diameter of the collet includes a ridged surface.

24. The clutch of claim 23, wherein the ridged surface comprises:
a surface finish selected from the group consisting of alternate concentric ridges and grooves closely spaced, screw threads, a knurled surface, and an etched surface.

25. The clutch of claim 22, wherein:
the collet is retained within the head piece by a retaining ring disposed in a circumferential groove within the head piece.

26. The clutch of claim 22, wherein:
the collet is retained within the tail piece by a retaining ring disposed in a circumferential groove within the tail piece.

27. The clutch of claim 22, wherein:
the main shaft includes a first end and a second end and a bypass valve disposed on the second end thereof that cooperates with a valve seat within the hollow cylindrical body; and
the valve is controlled by the clutch in cooperation with the first end of the main shaft.

28. The bypass plunger of claim 22, wherein:
the inside diameter of the collet is less than the diameter of the main shaft by at least 0.0005 inch.

* * * * *